US010245465B2

(12) United States Patent
Choi

(10) Patent No.: US 10,245,465 B2
(45) Date of Patent: Apr. 2, 2019

(54) DEVICE FOR PELVIC LIMB BLOOD FLOW

(71) Applicant: Hae-Yong Choi, Seoul (KR)

(72) Inventor: Hae-Yong Choi, Seoul (KR)

( * ) Notice: Subject to any disclaimer, the term of this patent is extended or adjusted under 35 U.S.C. 154(b) by 0 days.

(21) Appl. No.: 15/725,546

(22) Filed: Oct. 5, 2017

(65) Prior Publication Data

US 2018/0169467 A1 Jun. 21, 2018

(30) Foreign Application Priority Data

Dec. 16, 2016 (KR) ..... 10-2016-0172904

(51) Int. Cl.
*A63B 21/06* (2006.01)
*A63B 23/08* (2006.01)
*A63B 23/035* (2006.01)

(52) U.S. Cl.
CPC ..... *A63B 23/085* (2013.01); *A63B 21/0615* (2013.01); *A63B 23/03541* (2013.01); *A63B 2208/0233* (2013.01); *A63B 2208/0242* (2013.01)

(58) Field of Classification Search
CPC ..... A61H 1/0237; A61H 1/0266; A61H 2001/027; A63B 23/08–23/10; A63B 2208/0233; A63B 2208/0242; A63B 21/06; A63B 21/0615–21/0617; A63B 21/22; A63B 21/222; A63B 21/4011–21/4015; A63B 21/4034; A63B 21/4047; A63B 21/4049; A63B 2022/0033; A63B 2022/0038; A63B 2022/0074; A63B 22/0056–22/0069; A63B 23/0458; A63B 23/0464; A63B 23/0476; A63B 23/03541;
(Continued)

(56) References Cited

U.S. PATENT DOCUMENTS 2,374,730 A * 5/1945 De Forest ..... A63B 22/0056 482/80
3,020,046 A * 2/1962 Hotas ..... A63B 22/16 482/79

(Continued)

FOREIGN PATENT DOCUMENTS

KR 20-0255035 Y1 11/2001
KR 10-0654883 B1 12/2006

(Continued)

*Primary Examiner* — Joshua Lee
(74) *Attorney, Agent, or Firm* — Bacon & Thomas, PLLC

(57) ABSTRACT

A structure including left and right footplates and weight shafts provided at left and right sides in a blood circulation exercise interlocking device, providing a pelvic limb blood circulation ankle interlocking device comprising a vertical supporter configured at the center of a lower plate of a main body in a vertical direction, left and right auxiliary vertical supporters configured to be parallel in a vertical direction at left and right sides of the vertical supporter, rotary shafts configured at the same position as the left and right auxiliary vertical supporters in a horizontal direction of the vertical supporter, left and right rotary bars configured at left and right sides of the rotary shaft to be coupled with a rotating device, weights made of heavy metals at the upper ends of the left and right rotary bars, and left and right footplates configured at left and right rotation lower ends.

5 Claims, 8 Drawing Sheets

(58) Field of Classification Search
CPC ..... A63B 2210/02; A63B 21/4033; A63B 21/4035
USPC ..... 482/79, 80
See application file for complete search history.

(56) References Cited

U.S. PATENT DOCUMENTS 4,149,715 A * 4/1979 Kusmer ..... A63B 21/02 482/128
4,337,939 A * 7/1982 Hoyle ..... A63B 21/4047 482/79
4,452,447 A * 6/1984 Lepley ..... A63B 21/00845 36/11.5
4,708,339 A * 11/1987 Perrine ..... A63B 69/18 482/146
4,733,859 A * 3/1988 Kock ..... A63B 23/025 482/127
4,813,666 A * 3/1989 Costilow ..... A63B 21/0615 482/80
5,060,935 A * 10/1991 Dunn ..... A63B 21/0084 482/53
5,071,115 A * 12/1991 Welch ..... A63B 22/0056 482/127
5,188,577 A * 2/1993 Young ..... A63B 21/0615 482/53
5,320,588 A * 6/1994 Wanzer ..... A63B 22/0056 482/53
5,374,230 A * 12/1994 Bonnaime ..... A63B 21/00181 482/112
5,487,711 A * 1/1996 Little ..... A63B 21/0615 482/79
5,628,709 A * 5/1997 Chen ..... A63B 22/0064 482/146
6,709,368 B1 * 3/2004 Chue ..... A63B 21/015 482/52
6,796,928 B1 * 9/2004 Christopher ..... A63B 22/0056 482/123
8,029,420 B1 * 10/2011 Thati ..... A63B 21/023 482/79
8,439,854 B2 * 5/2013 Terrio ..... A61H 1/0266 482/79
9,241,863 B2 * 1/2016 Dhanai ..... A61H 1/0266
2004/0204293 A1 * 10/2004 Andreasen ..... A63B 21/00178 482/52
2007/0275833 A1 * 11/2007 Ramsey ..... A63B 23/085 482/79
2008/0146421 A1 * 6/2008 Hsieh ..... A63B 21/02 482/129
2017/0259113 A1 * 9/2017 Chen ..... A63B 21/4034

FOREIGN PATENT DOCUMENTS

KR 10-0853610 B1 8/2008
KR 10-1260642 B1 5/2013

* cited by examiner

FIG. 6A
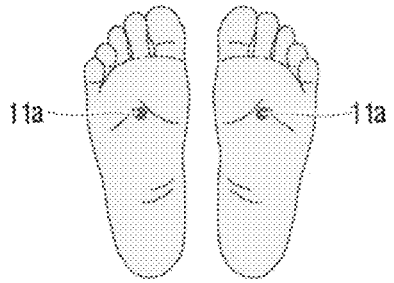
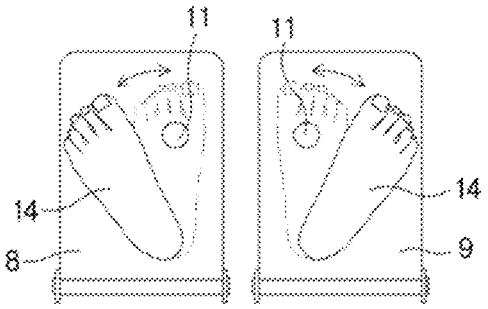
FIG. 6B

FIG. 7A
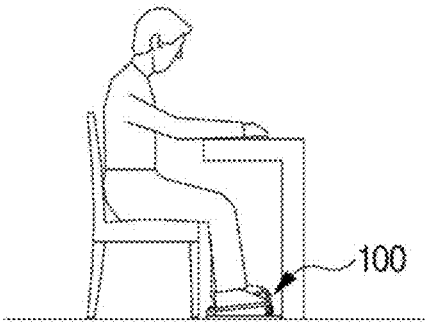
FIG. 7B
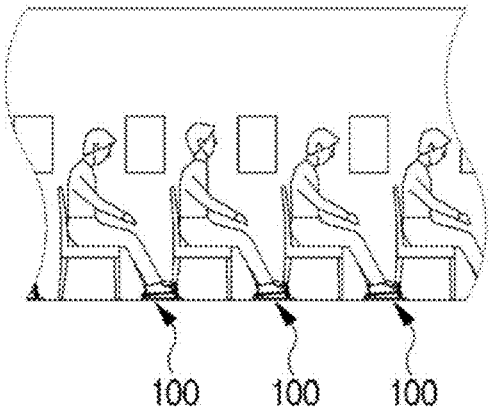
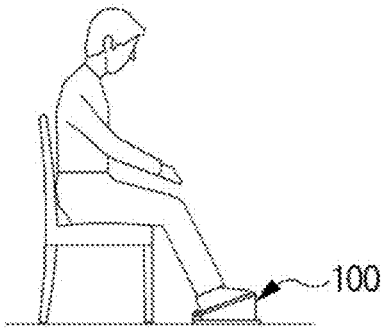
FIG. 7C

DEVICE FOR PELVIC LIMB BLOOD FLOW

CROSS-REFERENCE TO RELATED APPLICATION(S)

This application claims benefit of priority to Korean Patent Application No. 10-2016-0172904 filed on Dec. 16, 2016, in the Korean Intellectual Property Office, the disclosure of which is incorporated herein by reference in its entirety.

BACKGROUND OF THE INVENTION

The present invention relates to a interlocking device of left and right ankles that induces ankle movement such as walking to promote blood circulation from the pelvic limb to the upper body, and more particularly, to a device for pelvic limb blood flow that interlocks upward and downward based on left and right ankles by using the gravity action.

DESCRIPTION OF RELATED ART

Veins do not have the driving force of a heartbeat like an artery, and especially the flow of leg venous blood goes upside down against gravity from the sole to the heart.

The venous blood returns to the heart by external forces such as the force of breathing or contraction of the muscles, and the valve is in every part of the vein wall and serves to block backflow of the blood as a structure which opens so that the blood flows to only one side of the heart and closes when the blood flows backwards.

When these valves fail or become weak, venous blood containing waste products and carbon dioxide does not rise to the heart to be accumulated on the legs, the legs become swollen, heavy, and tired.

Also, when sitting in a cramped airplane seat for a long time, an economy-seat syndrome, a so-called pulmonary embolism that clogs the pulmonary blood vessels due to blood clots in the leg veins occurs.

For this reason, as illustrated in FIG. 8, the pelvic limb movement in the pelvic limb vein 15 requires movement of the blood from the leg part to the upper part by the cardiac pumping action, and if there is no pelvic limb movement, the blood flow of the vein becomes stagnant, and a thrombus develops herein, resulting in clogging of the pulmonary blood vessels, pulmonary embolism such as dyspnea and syncope occurs.

When sitting for a long time, the blood is often concentrated to toes, and as a result, a state in which the blood vessel is increased while the blood goes down to the toes and does not rise again is called pelvic limb varicose veins.

The calf muscle plays the role of raising the lowered blood vessels. For this reason, the calf is called the second heart, and the best exercise method to stimulate the calf muscles is an ankle exercise and a walking exercise.

Therefore, a blood circulation exercise in which the ankle exercise and the walking exercise are combined is required.

A muscular exercise device that develops the muscles of the knee cartilage and the pelvic limb muscles such as a stepper or a bicycle pedal structure which climbs up the stairs in the related art is not a device which walks for a long time. That is, the blood circulation exercise needs to be enough to stimulate the calf muscles, and the muscular exercise in which a separate physical force is applied cannot achieve the object of the present invention.

That is, since the blood circulation should be continuously maintained for a long time for at least 2 to 3 hours, the conventional exercise devices in which the force is applied usually increase fatigue due to the exhaustion of the body strength for 30 minutes or more and can not continue for a long time.

The exercise promotes smooth and light muscle activity for blood circulation, but an exercise to develop the muscle with excessive physical force may cause muscle fatigue, etc., which may interfere with blood circulation.

However, since the conventional exercise devices, that is, the exercise devices of the bicycle pedal system are exercises which rotate the left pedal and the right pedal at 360°, the exercise radius is large, and thus, there are many restrictions on the installation site, a large amount of muscle exercise is induced, and an auxiliary structure such as a frame constituting the pedal rotation structure itself has a large size and a large volume.

Conventional exercise devices such as steppers are muscle exercises that consume the strength of the body by forcibly applying force to a spring or a gas shock absorber, resulting in a serious exercise in the knee joint.

Accordingly, the present invention can not be applied to the continuous blood circulation for a long time.

In addition, the spring or the gas bubble generates heat when used for a long time, and the noise is increased due to wear.

Korean Patent Application No. 10-2013-0014924 relates to a muscle exercise device for training muscles.

Korean Utility Model Application No. 20-2001-0024755 and Korean Patent Application No. 10-2005-0021669 relate to simple acupressure devices that apply acupressure by elasticity of forced air elastic repulsion of an air tube.

Since the invention is not a function to interlock the left and right feet alternatively in sequence and the charged air has the physical force as it is in the fixed interior without changing the total amount position, it is necessary to pressurize it with a certain amount of force. As a result, in fact, an acupressure device is simply constituted on a simple air tube in which the elderly or the user can not adjust the force according to the strength.

Korean Patent Application No. 10-2014-0101054 is configured by a footplate spring and a back spring and in a seat type lower body exercise device in Korean Patent Application No. 10-2007-0117143, because the forcible force is induced by a buffered circular spring structure, the muscle exercise is induced. Especially, since a structure of a torsion spring used for the muscle exercise is merely the muscle development exercise using the rebound which is caused by the elasticity of the spring, physical limitations in usage for a long time use are accompanied and serious burden on knee cartilage is caused.

In addition, the noise caused by the elastic repulsion of the spring is considerably generated, and there are many restrictions on the use place.

Since the above-mentioned exercise devices a muscular exercise that is driven when the strength of the exercise is greater than a predetermined level of force due to a spring or air pressure, the user can not adjust the exercise strength according to the condition or the degree of physical strength.

Accordingly, since all of the conventional indoor exercise devices are related to muscle development exercises that use considerable physical strength by using physical repulsive force, the exercise devices can not be used for pregnant women with swollen legs that can not circulate blood, patients with cardiovascular disease in which a physical exercise is dangerous, and patients with diabetes who need a steady blood circulation and are not a means that circulates the blood to examinees and desk workers who do not have a separate exercise time.

SUMMARY OF THE INVENTION

When sitting for a long time, the blood is often concentrated to the toes, and the resulting pelvic limb varicose veins are the symptoms caused by the inability of the blood coming down to the toes to rise again.

However, the calf muscles play the role of raising the blood down, and the best exercise to stimulate the calf muscles rather than the muscle exercise is the ankle exercise.

The ankle exercise is to move the forefoot up and down with the heel as a base axis, and to make the left and right foot crossed sequentially.

In order to solve the above problem, the muscular exercise of the entire leg is not taken for a long time because it requires physical strength. Therefore, it is most effective to perform peristaltic motion continuously for a long time with the force of moving the calf muscles gently with the ankle as a base axis.

In order to achieve the above object, according to the present invention, the device itself is configured to smoothly operate left and right without a structure for generating a forced force, so that the forefoot is pivotally moved up and down with the heel as a base axis to obtain a gentle walking effect.

The effect of the pump, such as walking lightly by alternately driving the left and right feet sequentially without the need for a separate power structure, induces the effect of circulating blood from the pelvic limb vein to the upper body by gravity action.

It is possible to arbitrarily adjust the strength of the exercise according to the physical strength without any adjustment function by the user's will during the exercise so as not to overdo the exercise according to the physical strength and condition of the user.

In particular, since the user does not apply little force, it is proposed a structure which is smoothly driven as lightly walking without applying force to the knee cartilage or the surrounding muscles.

In addition, no noise should be generated during driving as described above.

Further, forced physical devices such as springs, gas shock absorbers, etc. which are used by conventional exercise devices are looser and worn out as be used, and are practically unusable for a long time.

When describing in more detail with reference to FIGS. 1 and 3, an aspect of the present invention includes a vertical supporter 2 configured at the center of a lower plate 1 of a main body in a vertical direction, left and right auxiliary vertical supporters 2*a* configured to be parallel to each other in a vertical direction at left and right sides of the vertical supporter 2, rotary shafts 2*b* configured at the same position as the left and right auxiliary vertical supporters 2*a* in a horizontal direction of the vertical supporter 2, left and right rotary bars 8*a* and 9*a* configured at left and right sides of the rotary shaft 2*b* to be coupled with a rotating device such as a bearing, weights 16 made of heavy metals at the upper ends of the left and right rotary bars 8*a* and 9*a*, and left and right footplates 8 and 9 configured at the lower ends of the left and right rotary bars 8*a* and 9*a*.

When a user presses the left and right footplates 8 and 9 based on the rotary shaft 2*b* configured in the middle of the left and right rotary bars 8*a* and 9*a*, the left and right footplates 8 and 9 rotate downward and then the weight 16 rotates upward.

When the user 12 releases the pressure from the left and right footplates 8 and 9, the weight 16 rotates automatically downward by the gravity by its own weight and then pelvic limb blood is circulated though a pelvic limb exercise.

Further, an auxiliary rotary shaft 2*d* is provided at the upper end of the vertical supporter 2, rotary weights 16*a* are provided at both sides of the auxiliary rotary shaft 2*d*, respectively, and a moving surface is formed at the lower end of the weight 16*a*.

The moving surface is configured to smoothly rotate and move without friction with the left and right wheels 5 and 6 made of an elastic material such as urethane, silicon, or rubber at the upper ends of the left and right rotary bars 8*a* and 8*b*.

As described above, the present invention is an automatic blood circulation ankle exercise device that operates by gravity force using the weight of the weight 16.

When the user sequentially presses the left and right footplates, the weight is sequentially rotated upward, and when the pressure is released, the weight 16 is automatically rotated downward by the weight.

The upward and downward movements of the left and right footplate structures are automatically interlocked in sequence to cause in the same effect as a walking exercise.

The user of the present invention can use the structure continuously for a long time without any exercise when the calf muscles are contracted and the calf muscles are lowered by contracting the calf muscles when the front foot is lifted upward based on the heel by the left and right footplates 8 and 9, relaxing the calf muscles when the front food is lowered downward, and promoting pelvic limb blood circulation when repeating the exercise at the left and right sequentially.

In addition, the vertical exercise within the above-mentioned predetermined angles do not require additional physical strength by contracting and relaxing the calf muscles, thereby promoting blood circulation for a long time and having no effect on the knee cartilage.

In addition, since the present invention is a device that is continuously used for a long time, it is impossible to have a wear-resistant structure as much as it is used with a spring or an absorber like a conventional exercise device. That is, since the present invention is a structure that utilizes gravity by weight, rather than an element that applies such a physical force, it is possible to use the structure for a long time.

Further, the user can adjust the strength of the exercise by arbitrarily adjusting the force for pressing the left and right footplates 8, 9 during the left and right interlocking operations as described above.

The present invention allows the user to comfortably exercise his or her physical strength and comfortable level of walking according to his/her condition, thereby promoting a continuous pelvic limb blood circulation for a long time without fatigue, relieving fatigue, preventing blood clotting, and recovering the strength.

In addition, since the structure of the present invention is adjusted to the structure capable of promoting blood circulation by activating the calf muscles by the walking and ankle exercise and obtaining a light walking effect by varying the weight 16 according to the user, it is possible to use the structure for a long time because there is no consumption of physical strength.

In addition, since the operation of the left and right footplates 8 and 9 is very smoothly interlocked by reducing the friction due to the inner bearing structure (not illustrated) and the external elastic structure of the left and right rotary wheels 5 and 6, there is no impact even when being used for a long time without noise and it can be used for a long time in various places such as the inner end of the desk or the lower end of the chair in reading room, office, work space, apartment without floor noise.

The left and right foots are smoothly acted by the minute transmitted force during the crossover movement, so that the user hardly causes the shock during use, does not cause the muscle exercise, and does not cause the noise.

Therefore, the present invention is a blood circulation interlocking device rather than the muscle exercise and examinees or office staffs having no exercise-time as well as pregnant women with swollen legs that can not circulate blood, patients with cardiovascular disease in which a physical exercise is dangerous, and patients with diabetes who need a steady blood circulation have n effect of increasing a blood circulation effect are lightly walking while studying or working, thereby increasing a blood circulation effect.

BRIEF DESCRIPTION OF DRAWINGS

The above and other aspects, features, and advantages of the present invention in which:

FIG. 6A is a diagram of regional cerebral blood flow of the sole;

FIG. 6B is a diagram for usage of the sole;

FIG. 7A is a diagram at the time of being coupled with a table of the present invention;

FIG. 7B is a diagram at the time of being installed in a transportation means;

FIG. 7C is a diagram at the time of being coupled with a chair; and

DETAILED DESCRIPTION OF THE INVENTION

Figure 1:
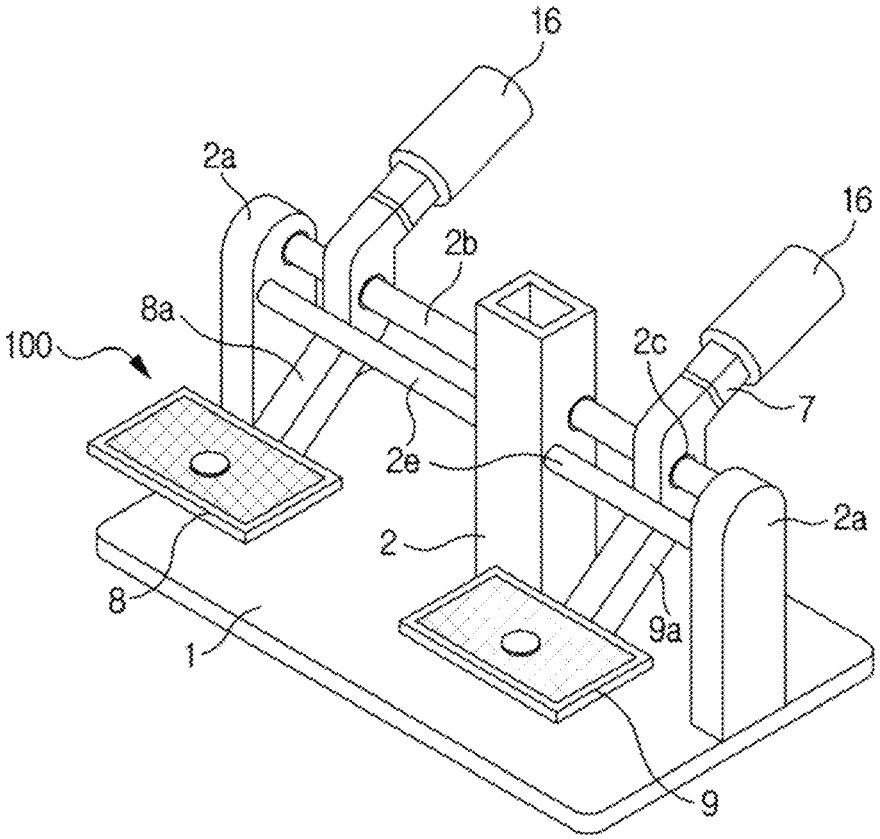
FIG. 1 illustrates Example 1 of the present invention.

An object of the present invention is to provide a configuration in which passengers who are seated in a narrow seat in an airplane seat, a train, a bus, and a car, a long-time worker in front of a desk, and examinees who study in a reading room, promote the repetitive and steady contraction and relaxation of the calf muscles through the walking, the foot, and the ankle movements to steadily perform blood circulation from the pelvic limb using the same pumping effect as that of walking.

As illustrated in FIGS. 1, 2, 3, and 4, the present invention includes a vertical supporter 2 configured at the center of a lower plate 1 of a main body in a vertical direction, a rotary shaft 2*b* configured in a horizontal direction of the vertical supporter 2, left and right rotary bars 8*a* and 9*a* configured at left and right sides of the rotary shaft 2*b*, a weight 16 configured at the upper end of the left and right rotary bars 8*a* and 9*a* to rotate from the vertical direction to the horizontal direction by gravity acting on its own weight, and left and right footplates 8 and 9 configured at the lower end of the left and right rotary bars 8*a* and 9*a* to automatically rotate in a vertical direction by the gravity action of the weight 16.

When the user releases the pressure of the left and right footplates 8 and 9, the weight 16 rotates downward by the gravity action by its own weight and then the left and right footplates 8 and 9 automatically rotate upward until reaching stop shaft 2*e*.

When the user releases the pressure of the left and right footplates 8 and 9, the weight 16 rotates downward by the gravity action by its own weight and then the left and right footplates 8 and 9 automatically rotate upward.

Further, an auxiliary rotary shaft 2*d* is provided at the upper end of the vertical supporter 2, rotary weights 16*a* are provided at both sides of the auxiliary rotary shaft 2*d*, respectively, and a moving surface (not illustrated) is formed at the lower end of the weight 16*a*.

Left and right wheels 5 and 6 made of an elastic material configured by one of urethane, silicon, or rubber are configured at the upper ends of the left and right rotary bars 8*a* and 8*b*.

The structure may be coupled with a chair structure or coupled with a desk structure or a bed structure.

This will be described in detail with reference to the drawings.

Figure 2:
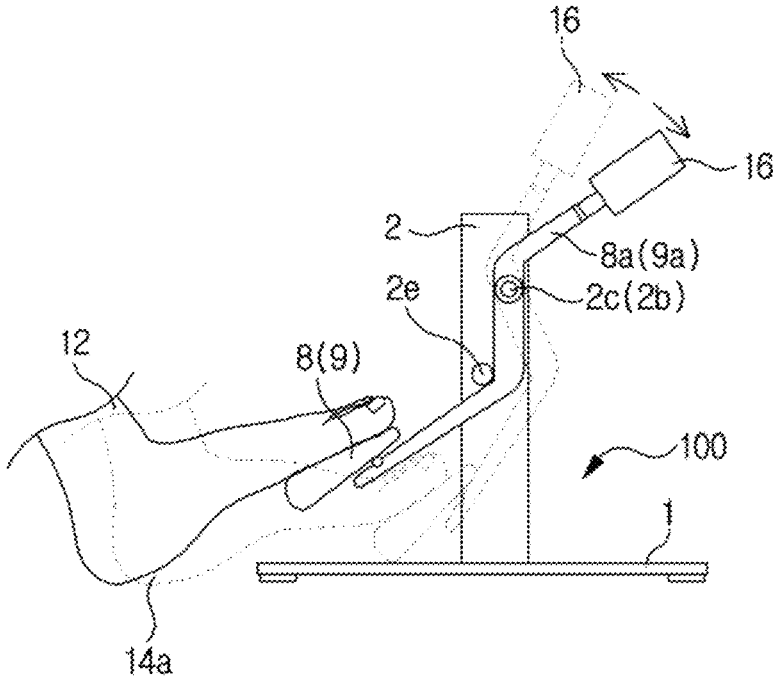
FIG. 2 is an operational diagram of FIG. 1.
Figure 4:
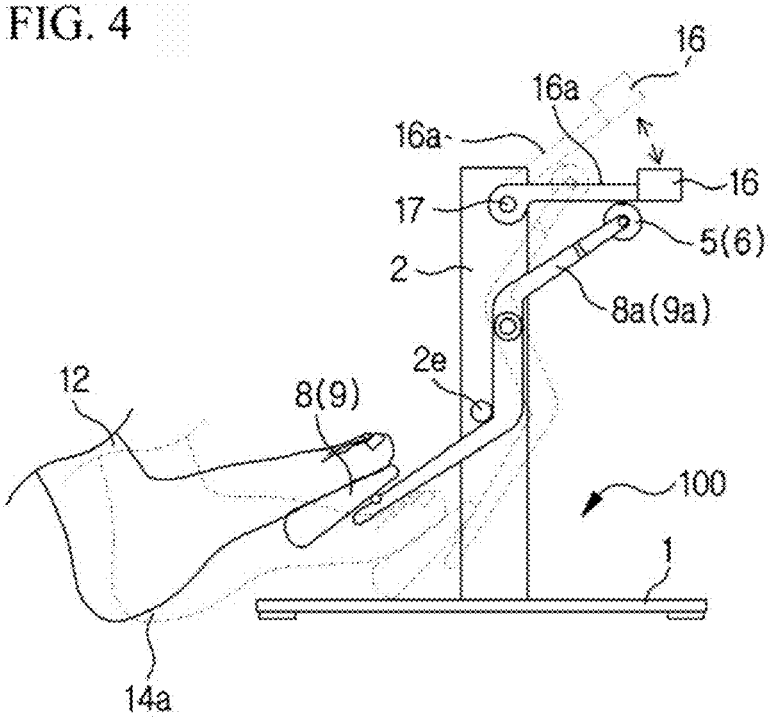
FIG. 4 is an operational diagram of FIG. 3.

That is, as illustrated in FIGS. 2 and 4, when the user presses the front foot downward by the left footplate 8 based on the heel 14*a*, the calf muscles on the left footplate 8 are contracted and when the left footplate 8 is lowered, the calf muscles are relaxed.

In the same principle, when the right footplate 9 is pressed downward, the calf muscles on the right footplate 9 are contracted and when the right footplate 9 is lowered, the calf muscles are relaxed.

By repeating this sequence, the left and right calf muscles on the left and right footplates 8 and 9 are sequentially contracted and relaxed to sequentially and continuously promote blood circulation in the pelvic limb and maintain venous circulation such as cardiac pumping.

Further, since the above blood circulation needs to be constantly continued for a long time, the structure itself is configured by a structure with no noise.

The present invention will be described in detail in the following Examples with reference to the drawings.

As illustrated in FIGS. 1 and 2, the vertical supporter 2 is configured at the center of the lower plate 1 of the main body in the vertical direction.

Left and right auxiliary vertical supporters 2*a* are configured at left and right sides of the lower plate 1 of the main body to be parallel to the vertical supporter 2 in the vertical direction.

The rotary shaft 2*b* is configured in the horizontal direction at the same position of the vertical supporter 2 as the auxiliary vertical supporters 2*a*.

Figure 5:
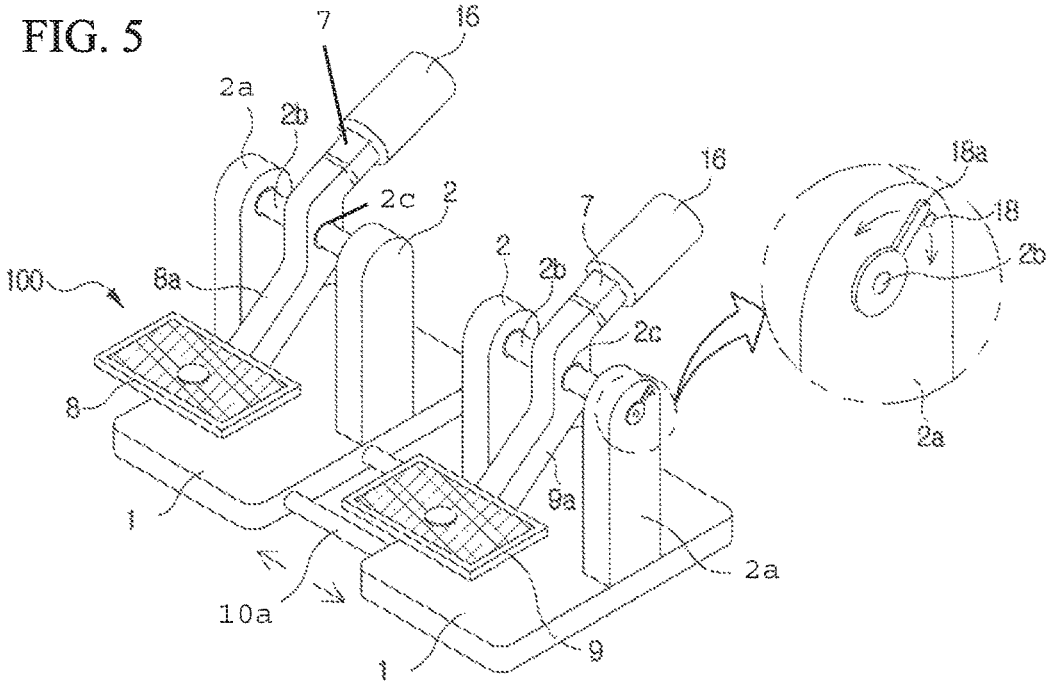
FIG. 5 is an application embodiment of the present invention.
Figure 8:
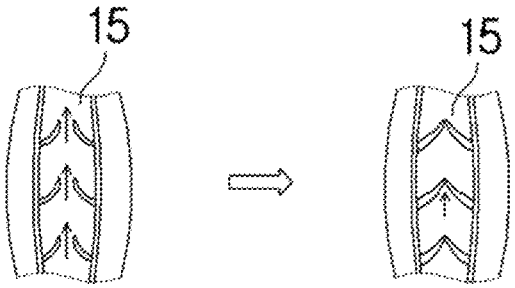
FIG. 8 is a reference diagram of venous blood.

The left and right rotary bars 8*a* and 9*a*, as shown in FIG. 5, are configured at a predetermined proper height of the vertical supporter 2 in a horizontal direction, and are provided at both the left and right sides of the rotary shaft 2*b*, which is formed in the shape of a bar respectively, to be coupled with a rotating device 2*c* such as a bearing.

The weights 16 made of a material having a large weight density such as metals such as heavy iron and plastic are configured at the upper ends of the left and right rotary bars 8*a* and 9*a*, respectively.

The left and right footplates 8 and 9 are configured at the lower ends of the left and right rotary bars 8*a* and 9*a* and the weights 16 are configured at the upper ends of the left and right rotary bars 8*a* and 9*a*, respectively.

The weight of the weight 16 may be adjusted depending on user's physical strength.

A method of adjusting the weight of the weight 16 depending on user's physical strength is a method of selectively adjusting the weight itself of the weight 16 and as another method, the weight may be adjusted by varying a position of the weight 16.

The left and right footplates 8 and 9 are formed in a shape having a downward angle based on the vertical supporter 2 as illustrated in FIGS. 1 and 2.

That is, when the user presses the left and right footplates 8 and 9 based on the heel, the left and right footplates 8 and 9 move to the lower plate 1 of the main body by rotating the left and right rotary bars 8*a* and 9*a* and each of the weights 16 at the upper ends of the left and right rotary bars 8*a* and 9*a* is configured to be vertically close to each other and configures the angular range so as not to exceed the vertical state.

That is, the left and right rotary bars 8*a* and 9*a* are formed in an S shape as illustrated in FIG. 2, the weight 16 is formed at the upper end of the S shape, and the left and right footplates 8 and 9 are formed at the lower end of the S shape. When the left and right footplates 8 and 9 are pressed based on the rotary shaft 2*b* to rotate downward by forming the rotary shaft 2*b* at the center of the left and right rotary bars 8*a* and 9*a*, the weight 16 rotates upward and when the user releases the pressure from the left and right footplates 8 and 9, the weight 16 automatically rotates downward by the gravity by its own weight until reaching the stop shaft 2*e*.

As such, in the configuration of the present invention, as illustrated in FIG. 2, when the user sequentially presses the left and right footplates 8 and 9 with front surfaces of the left and right foots based on the left and right heels 14*a*, each of the left and right rotary bars 8*a* and 9*a* rotates based on the rotary shaft 2*b* and then the upper weight 16 rotates.

When the pressure is released from the left and right footplates 8 and 9, each upper weight 16 rotates downward by the gravity action by its own weight and the left and right footplates 8 and 9 automatically rotates upward.

When the left and right footplates 8 and 9 are sequentially pressed, an effect of walking continuously is obtained.

The shapes of the left and right rotary bars 8*a* and 9*a* are not limited to the S shape and may be configured in various shapes such as a Z shape, an L shape, and the like. However, in a basic principle, when the left and right footplates 8 and 9 are pressed based on the rotary shaft 2*b* and rotating device 2*c* and rotates downward, the weight 16 rotates upward, and when the user 12 releases the pressure from the left and right footplates 8 and 9, the weight 16 is configured to automatically rotate and move downward by the gravity by its own weight.

That is, the feature of the present invention is an automatic blood circulation ankle exercise device that operates by gravity force using a weight of the weight 16.

The material of the weight 16 may use a plastic material as well as heavy iron and metals.

Accordingly, the configuration angle of the weight 16 is set within a vertical form, that is, an angle of less than 90°, that is, a vertical angle within 89° based on a horizontal direction at the time of rotating and within 0° based on the horizontal direction at the time of moving downward.

For this reason, when the weight 16 fall down at more than 90° with respect to the vertical direction and the associated left and right footplates 8 and 9 cross the rotary shaft 2*b* at 0° or less in the horizontal direction, and thus, vertical interlocking action becomes impossible.

In the actual configuration of the present invention, the upper and lower rotation directions of the weight 16 are preferably set to be between 15° and 45° upward. Therefore, the movement width of the left and right footplates 8 and 9 is preferably 45° to 15° downward.

The reason for configuring this is that the object of the present invention is not muscular movement of breeding the muscle like a conventional stepper.

The muscle exercise device can not be used for a long time like walking. An object of the present invention is to provide a pelvic limb venous blood circulation through an ankle exercise by obtaining an effect of walking continuously for a long time without human effort as if a person is walking for a long time.

Another example will be described.

Figure 3:
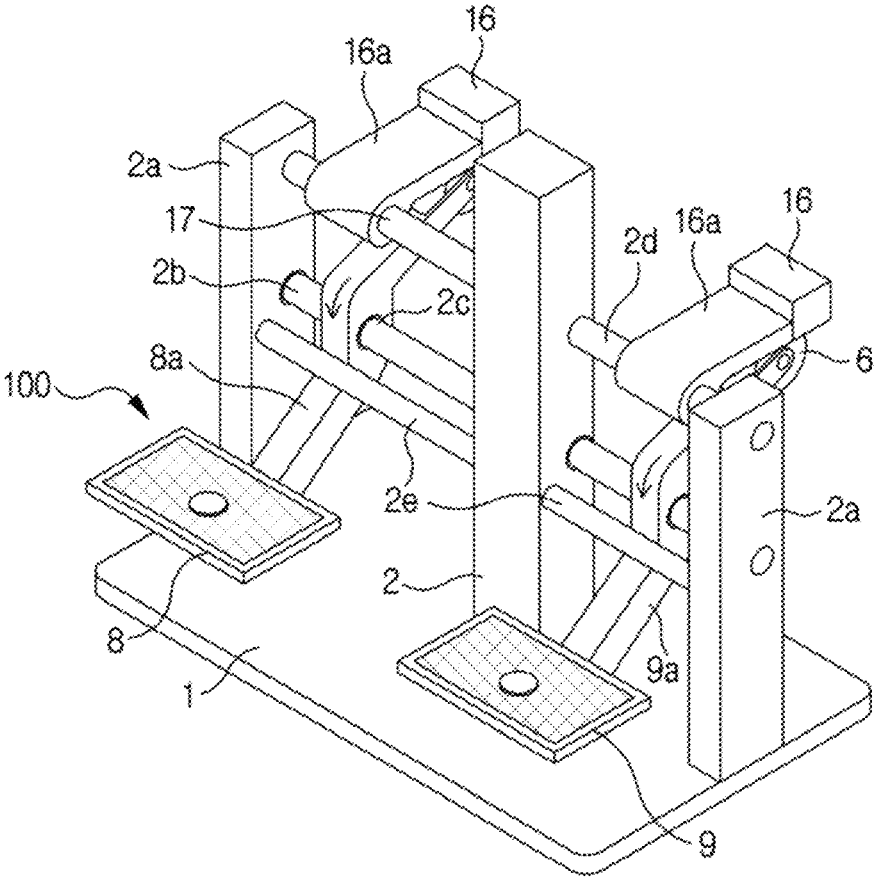
FIG. 3 illustrates Example 2 of the present invention.

As illustrated in FIG. 3, a structure in which a vertical supporter 2 is configured at the center of a lower plate 1 of a main body in a horizontal direction, auxiliary vertical supporters 2*a* are provided at left and right ends thereof, and a rotary shaft 2*b* is provided based on the vertical supporter 2 is the same as the structure of FIG. 1.

However, the configuration of the weight 16 is different.

That is, an upper rotary shaft 2*d* is further configured at the upper end of the vertical supporter 2 in a horizontal direction, and rotary weights 16*a* are provided at left and right ends of the rotary shaft 2*d*, respectively.

A rear configuration of the rotary weight 16*a* is associated with the upper rotary shaft 2*d* by coupling the rotary shaft 17 with the bearing and the like and the front end of the rotary weight 16*a* is formed by the weight 16 made of a metal having a large weight.

A moving surface 16*b* is formed at the lower surface of the rotary weight 16*a* to smoothly rotate and move without friction with the left and right wheels 5 and 6 made of an elastic material such as urethane, silicon, or rubber provided at the upper end of the left and right rotary bars 8*a* and 8*b*.

In the present invention, as illustrated in FIG. 4, when a user 12 releases pressure from the left footplate 8 or the right footplate 9, the rotary weight 16*a* descends by the gravity action with the weight force of each weight 16.

In this case, since the wheel itself rotates while the left and right wheels vertically rotate and move, the bottom of the rotary weight 16*a* softly rotates without friction and noise.

Accordingly, when the left and right footplates 8 and 9 are sequentially pressed, the user has the same effect as walking by the action of the left and right rotary weights 16*a* and pelvic limb blood circulation pumping is enabled like a heart pump.

As illustrated in FIG. 6A, a dented portion at the upper middle part of the sole is called a regional cerebral blood flow 11*a*.

The regional cerebral blood flow 11*a* is medically known as a blood aperture in which aura nerves, blood vessels of the whole body gather in one place.

The regional cerebral blood flow is the most important portion of the sole and when the regional cerebral blood flow is messaged, it helps to relieve fatigue by improving the blood circulation in the whole body and recovering vitality.

However, conventional acupressure-related products have many ridges on the floor to allow the user to feel the pain of the sole and thus are not used for a long time.

Further, the regional cerebral blood flow is a part having an effect when the entire portion needs to be pressed like a message and has no effect when being pressed like a conventional needle.

The present invention is configured by one ridge hemisphere 11 to press the entire portion of the regional cerebral blood flow like the message for blood circulation on the surfaces of the left and right footplates 8 and 9 as illustrated in FIG. 6B by considering the disadvantage.

The ridge hemisphere having the whole hemispherical shape is an elastic material and there is an effect that the user does not cause the pain even if the ridge hemisphere is used for a long time.

In more detail, the material of the ridge hemisphere 11 is composed of a soft elastic material with high self-elasticity such as silicon, rubber, and urethane, and the shape is formed so that the effect of acupressure on the regional cerebral blood flow is generated by the elasticity of its own material, as if it is gently massaged by pressing the whole part of the regional cerebral blood flow of the soles 14 in the elastic material of the hemisphere.

Accordingly, the present invention is applied to all of the Examples if necessary, and as illustrated in FIG. 5, the effect is enhanced by combining the acupressure exercise in the regional cerebral blood flow and the blood circulation movement in the left and right interlocking exercise.

In the Example, the vertical rotation angle of the front foot of the user based on the vertical supporter 2 is not limited, but preferably within 50°. The angle is more preferably about 20°.

The reason is that when the angle is greater than or equal to 50°, the excessive force of the ankle ligaments is caused and brought about the pain, and thus blood circulation interlocking exercise for a long time is difficult.

As such, according to the present invention, in order to compensate for a gap between left and right pelvic limbs depending on the user's physique, as shown in FIG. 5, the vertical supporter 2 of FIGS. 1 and 3 is divided into two parts, and thus the left and right rotary bars 8*a* and 9*a*, the left and right footplates 8 and 9, the left and right weights 16 and the main body board 1 are separated into left and right parts, and a general gap adjustment device 10*a* is configured therebetween to adjust the left and right gaps. Instead of using stop shaft 2*e*, as seen in FIG. 5, stopping device 18 can be used, which includes a protrusion and rotating arm 18*a* to control the rotation of the left and right footplates 8 and 9 and rotary shaft 2*b*.

Due to vertical pump exercise that maintains the pelvic limb blood continued for a long time instead of the muscle exercise, noise may occur when a small amount of shock is accumulated during exercise and since used places of the product are spaces where multiple people live simultaneously like offices, reading rooms, and apartments, the noise needs not to occur. An object of the present invention is to prevent noise from occurring.

In the structure of the present invention, the vertical supporter is provided at the front end of the lower surface of the main supporting plate 1, and when the vertical supported is rotated and erected, the user of the present invention may use the vertical supporter in a square shape at a convenient angle and carry the vertical supporter to be folded when not in use.

Further, in the present invention, it is possible to perform blood circulation exercise without difficulty to examinees or office staffs who sit at a desk for a long time as illustrated in FIG. 7A, and airplane, train, bus, and car passengers traveling in narrow spaces for long periods of time, pregnant women with swollen legs that can not circulate blood, patients with cardiovascular disease in which a physical exercise is dangerous, and patients with diabetes who need a steady blood circulation as illustrated in FIGS. 7B and 7C.

As illustrated in FIG. 7C, several occupational workers sitting in chairs can continue blood circulation exercise like walking while working or studying without a separate exercise time by installing the structure under the desk, thereby promoting studying concentration and fatigue recovery with the working effect.

In addition, when the whole structure of the present invention is attached to one side of the bed in hospitals and the like, the patient may take a pelvic limb blood circulation exercise even while lying down.

Therefore, the present invention is a device which allows the user to perform blood circulation without strength for a long time to stimulate pelvic limb muscles like walking by using gravity based on the ankle base as well as muscle exercise that applies force to physically unreasonable muscles, such as absorbers like a conventional stepper, springs, elastic devices, and air compressors.

Therefore, examinees and desk workers who do not have time to exercise and users who do not have time to exercise study or work without a separate exercise time or work while working, traveling, or watching TV and have a light walking exercise effect to promote pelvic limb blood circulation, thereby restoring fatigue, preventing accumulation of fatigue, and preventing pulmonary embolism.

What is claimed is:

1. A device for pelvic limb blood flow comprising:

a vertical supporter extending vertically from a lower plate of a main body in a vertical direction;

a rotary shaft configured in a form of a bar at a predetermined height on the vertical supporter and extending horizontally from the vertical supporter in;

left and right rotary bars each having an upper end and a lower end that are configured to rotate up and downward, respectively, around the rotary shaft;

first and second weights provided at the upper ends of the left and right rotary bars, respectively; and left and right footplates provided at the lower ends of the left and right rotary bars, respectively, wherein when a user sequentially presses on the left and right footplates, the first and second weights sequentially rotate upward by a rotation of the left and right rotary bars around the rotary shaft, respectively, and when the user releases pressure off the left and right footplates, the first and second weights rotate downward by gravity to return the left and right footplates back to an initial position.

2. The device for pelvic limb blood flow of claim 1, wherein the device is used with a chair structure.

3. The device for pelvic limb blood flow of claim 1, wherein the device is used with a desk structure.

4. The device for pelvic limb blood flow of claim 1, wherein the device is used with one side of a bed structure.

5. The device for pelvic limb blood flow of claim 1, further comprising a stop shaft configured on the vertical supporter to stop the left and right rotary bars from rotating past the stop shaft.

* * * * *